US008348016B2

(12) United States Patent
Lewis et al.

(10) Patent No.: US 8,348,016 B2
(45) Date of Patent: Jan. 8, 2013

(54) DESCENDER WITH FALL ARREST AND CONTROLLED RATE OF DESCENT

(76) Inventors: Richard W. Lewis, Birmingham, AL (US); Lance Wolf, Madison, AL (US)

( * ) Notice: Subject to any disclaimer, the term of this patent is extended or adjusted under 35 U.S.C. 154(b) by 344 days.

(21) Appl. No.: 12/548,242

(22) Filed: Aug. 26, 2009

(65) Prior Publication Data

US 2011/0048852 A1 Mar. 3, 2011

(51) Int. Cl.
*A63B 29/00* (2006.01)

(52) U.S. Cl. ..... 182/192; 182/5; 182/193

(58) Field of Classification Search ..... 182/5, 192, 182/193, 241; 188/65.4, 65.5
See application file for complete search history.

(56) References Cited

U.S. PATENT DOCUMENTS

| | | | | | |
|---|---|---|---|---|---|
| 375,587 | A | * | 12/1887 | Wakeman | 188/65.5 |
| 387,436 | A | * | 8/1888 | O'Neil | 182/100 |
| 394,109 | A | * | 12/1888 | Fowler | 188/65.3 |
| 398,826 | A | * | 3/1889 | Fowler | 182/192 |
| 1,277,339 | A | * | 8/1918 | Odgers | 182/72 |
| 4,253,218 | A | | 3/1981 | Gibbs | |
| 4,502,668 | A | | 3/1985 | Dodge, Jr. | |
| 4,542,884 | A | | 9/1985 | Dodge, Jr. | |
| 4,546,851 | A | | 10/1985 | Brennan | |
| 4,576,248 | A | * | 3/1986 | Marom | 182/5 |
| 4,580,658 | A | * | 4/1986 | Brda | 182/5 |
| 4,729,456 | A | | 3/1988 | Sugiyama | |
| 4,787,474 | A | | 11/1988 | Brennan | |
| 4,923,037 | A | | 5/1990 | Stephenson | |
| 5,054,577 | A | * | 10/1991 | Petzl et al. | 182/5 |
| 5,076,400 | A | * | 12/1991 | Petzl et al. | 188/65.5 |
| 5,360,083 | A | | 11/1994 | Hede | |
| 5,577,576 | A | * | 11/1996 | Petzl et al. | 188/65.4 |
| 5,597,052 | A | | 1/1997 | Rogleja | |
| 5,924,522 | A | | 7/1999 | Ostrobrod | |
| 5,934,408 | A | * | 8/1999 | Flux | 182/5 |
| 5,954,153 | A | | 9/1999 | Rogelja | |
| 5,975,243 | A | | 11/1999 | Lorbek | |
| 6,019,195 | A | | 2/2000 | Pelofi | |
| 6,095,502 | A | | 8/2000 | Dodge, Jr. | |
| 6,793,046 | B2 | | 9/2004 | Petzl | |
| 6,843,346 | B2 | * | 1/2005 | LeBeau et al. | 182/5 |
| 7,108,099 | B2 | | 9/2006 | Ador | |
| 2006/0070809 | A1 | | 4/2006 | Barzilai | |
| 2006/0289235 | A1 | | 12/2006 | Chen | |
| 2008/0087498 | A1 | | 4/2008 | Barzilai | |
| 2008/0149433 | A1 | | 6/2008 | Barzilai | |
| 2009/0026023 | A1 | | 1/2009 | Petzl | |
| 2009/0045010 | A1 | * | 2/2009 | Jordan | 182/5 |

FOREIGN PATENT DOCUMENTS

| | | | |
|---|---|---|---|
| FR | 2554102 | A1 * | 5/1985 |
| JP | 07000551 | | 1/1995 |
| JP | 2007255709 | | 10/2007 |

* cited by examiner

*Primary Examiner* — Alvin Chin Shue
(74) *Attorney, Agent, or Firm* — Paul M. Sykes; Bradley Arant Boult Cummings LLP

(57) ABSTRACT

A device for providing a controlled maximum rate of descent down a rope and fall arrest. The device includes a movable cam that in response to tension on a rope pivots into a closed position, jamming the rope within the device and arresting a fall. Force applied to a torque arm coupled to the cam allows the cam to be pivoted to its open position, which allows rope travel. As cam is opened, the rope travels a more sharply angular path through the device, which creates a frictional force on the rope sufficient to limit the maximum rate of descent.

23 Claims, 6 Drawing Sheets

DESCENDER WITH FALL ARREST AND CONTROLLED RATE OF DESCENT

TECHNICAL FIELD

This invention is related to the devices used to lower, rappel, or otherwise permit descent of a person or object down a rope or line in a controlled manner.

BACKGROUND

Individuals engaged in many different types of activities above the ground use ropes or safety lines to secure and protect themselves from a fall. Such activities may include utility workers working atop poles or other equipment; firefighters or other rescue personnel working atop or alongside a building; and construction workers working on tall buildings. The use of safety lines is not limited to work applications. The safety of various recreational activities is dramatically increased by the use of ropes or safety lines. These activities include, for example, rock climbing and spelunking. In addition, hunters who hunt from elevated platforms also can benefit from the use of safety ropes.

A rope alone, however, does not provide a complete solution. The rope should be secured to the person in a manner that allows the person to adjust his position on the rope (such as by when climbing or descending) but still protects the person from a fall. A variety of devices to provide fall protection have been developed, which typically operate as follows. A rope threads through the device, and the device is securely attached to a harness worn by a person with a carabineer. The rope slides through the device so long as the rope is relatively slack. Tension upon the rope usually causes a movable cam in the device to rotate into a position that binds the rope and thereby halts the passage of the rope through the device. If the tension is caused by a person falling, the device jams the rope and arrests the fall.

Some devices also include a lever attached to the cam that can be used to open the cam and release the rope. With the cam in open position on such devices, however, there is no appreciable friction on the rope, such that the rate of descent is quite rapid. If the operator were to panic and hold the lever such that the cam in the open position while descending, the rapid rate of descent could result in injury.

Another shortcoming of existing devices is that they cannot be operated remotely. If a person were to become unconscious and fall, or become unconscious as a result of the fall, or otherwise be injured such that he could not operate the device, his fall may be arrested. However, it may be impossible to lower him in a controlled manner without requiring a rescuer to go to the same perilous situation as the incapacitated person.

Thus, there exists a need for a safety device that provides automatic fall arrest, but allows for a safe, maximum rate of descent as an anti-panic feature. It would be further advantageous if such a device could be operated by remotely.

SUMMARY

Embodiments of the present invention satisfy these needs. One embodiment of the present invention comprises a descender for controlling the descent of a person along a rope comprising an entry pin, a fixed guide member comprising an internal lateral face and an oblong end, with the internal lateral face including a first jamming surface; a cam pivotable about a pivot axis from an open position to a closed position, the cam having a peripheral face comprising a second jamming surface and an arcuate shoulder with a trailing edge; and an exit pin. The entry pin and the oblong end define a rope entry. The exit pin and the trailing edge of the cam's shoulder define a rope exit. The internal lateral face and the peripheral face of the cam define a rope travel path between the rope entry and the rope exit. This embodiment also includes a cam stop positioned to stop the pivoting of the cam in its open position; and a torque arm coupled to the pivot axis of the cam for pivoting the cam from its closed position to its open position. In the absence of force applied to the torque arm, tension on a rope passing through the rope travel path causes the cam to pivot into its closed position, in which the rope is jammed between the jamming surface of the fixed guide member and the jamming surface of the cam. This halts rope travel through the device. As force is applied to the torque arm to pivot the cam to its open position, the jamming surfaces separate to permit rope travel and the trailing edge of the cam's shoulder pivots away from the exit pin, which increases the friction between the rope and the exit pin and the cam's shoulder to thereby limit the rate of rope travel through the device.

BRIEF DESCRIPTION OF THE DRAWINGS

The present invention will be explained, by way of example only, with reference to certain embodiments and the attached Figures, in which.

DETAILED DESCRIPTION

Figure 1:
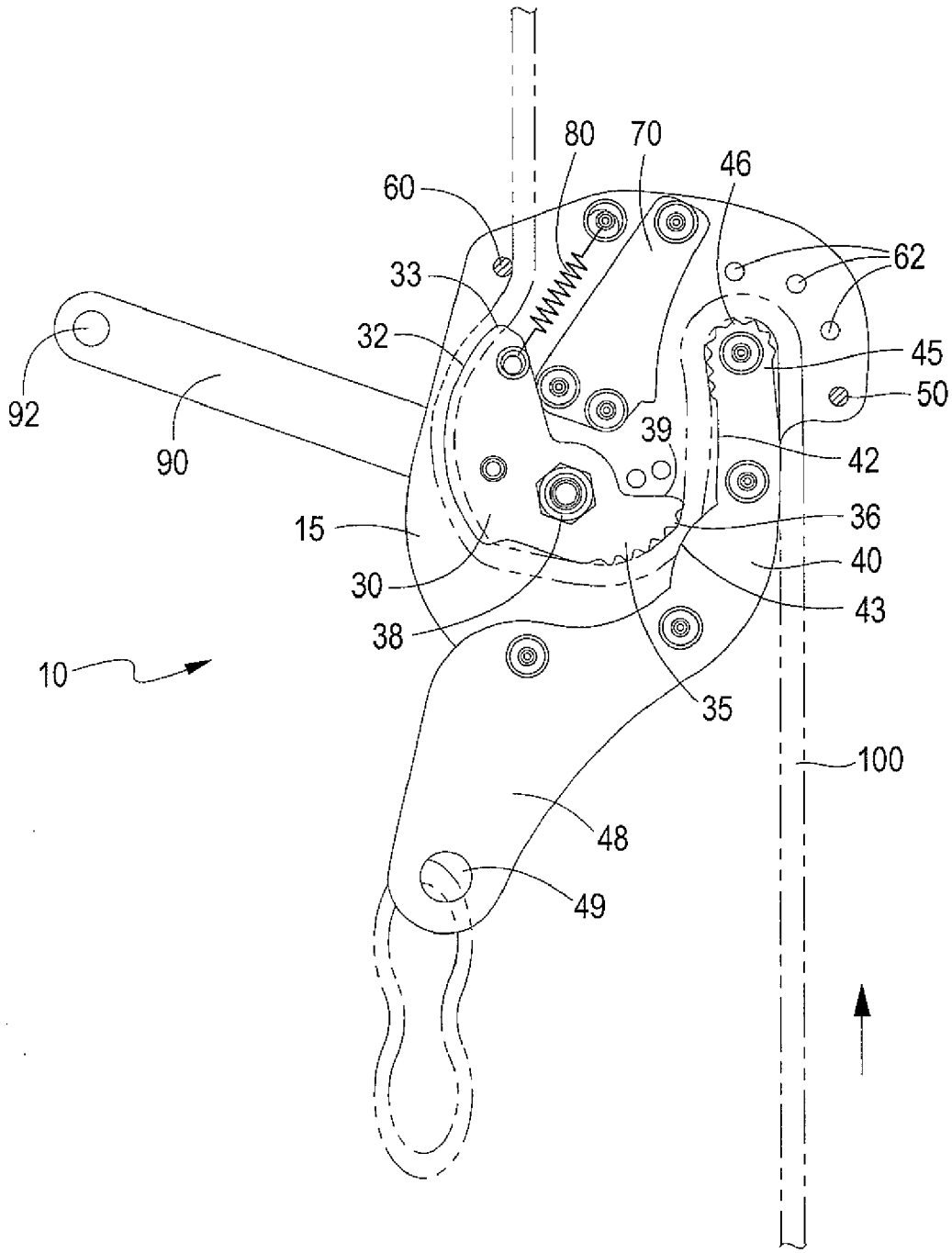
FIG. 1 is a top view of one embodiment of the invention, with the cover removed to reveal the internal components, with the cam in a closed position against the rope.
Figure 2:
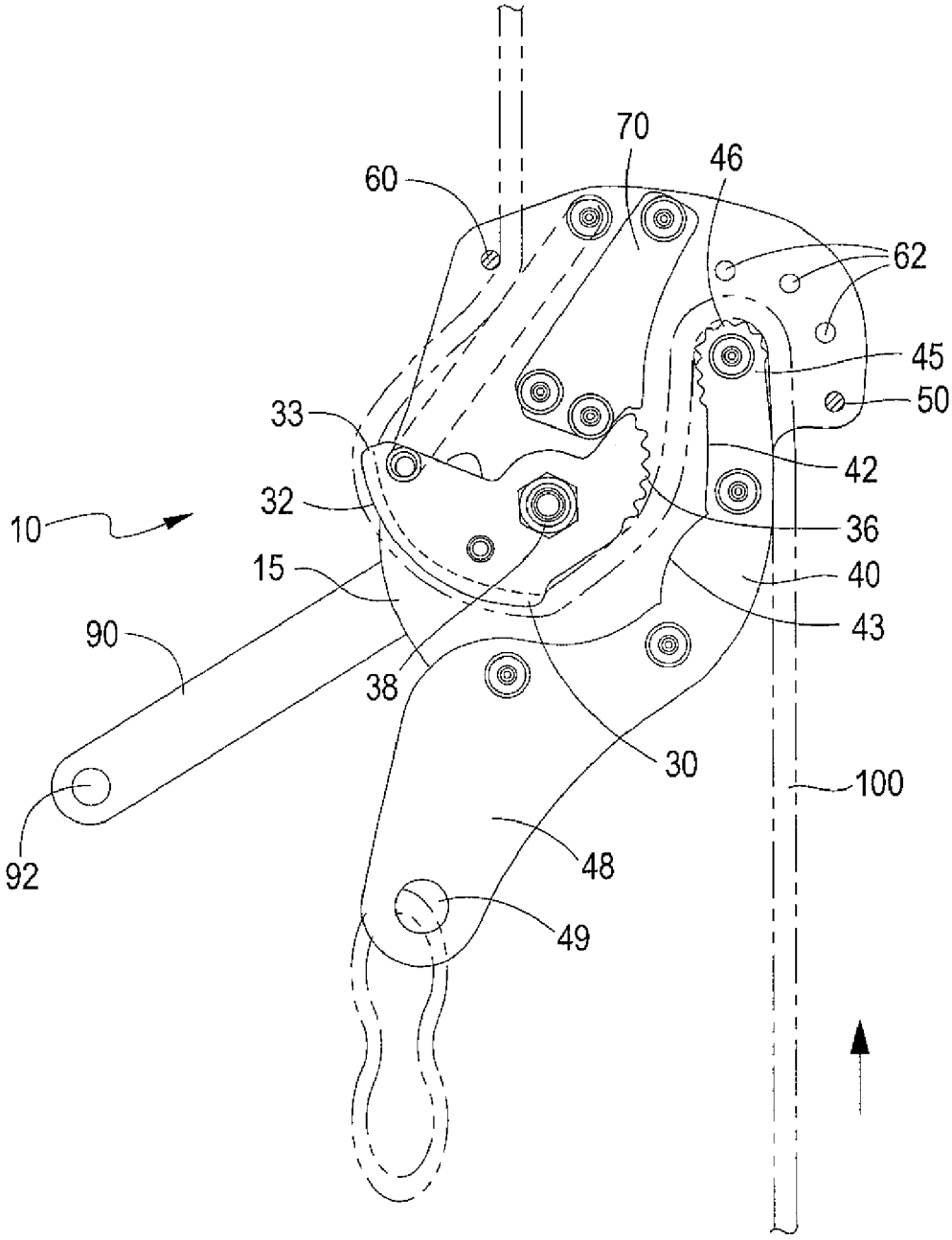
FIG. 2 is a top view of the embodiment shown in FIG. 1, with the cover removed to reveal the internal components, with the cam in an open position permitting rope travel.
Figure 3:
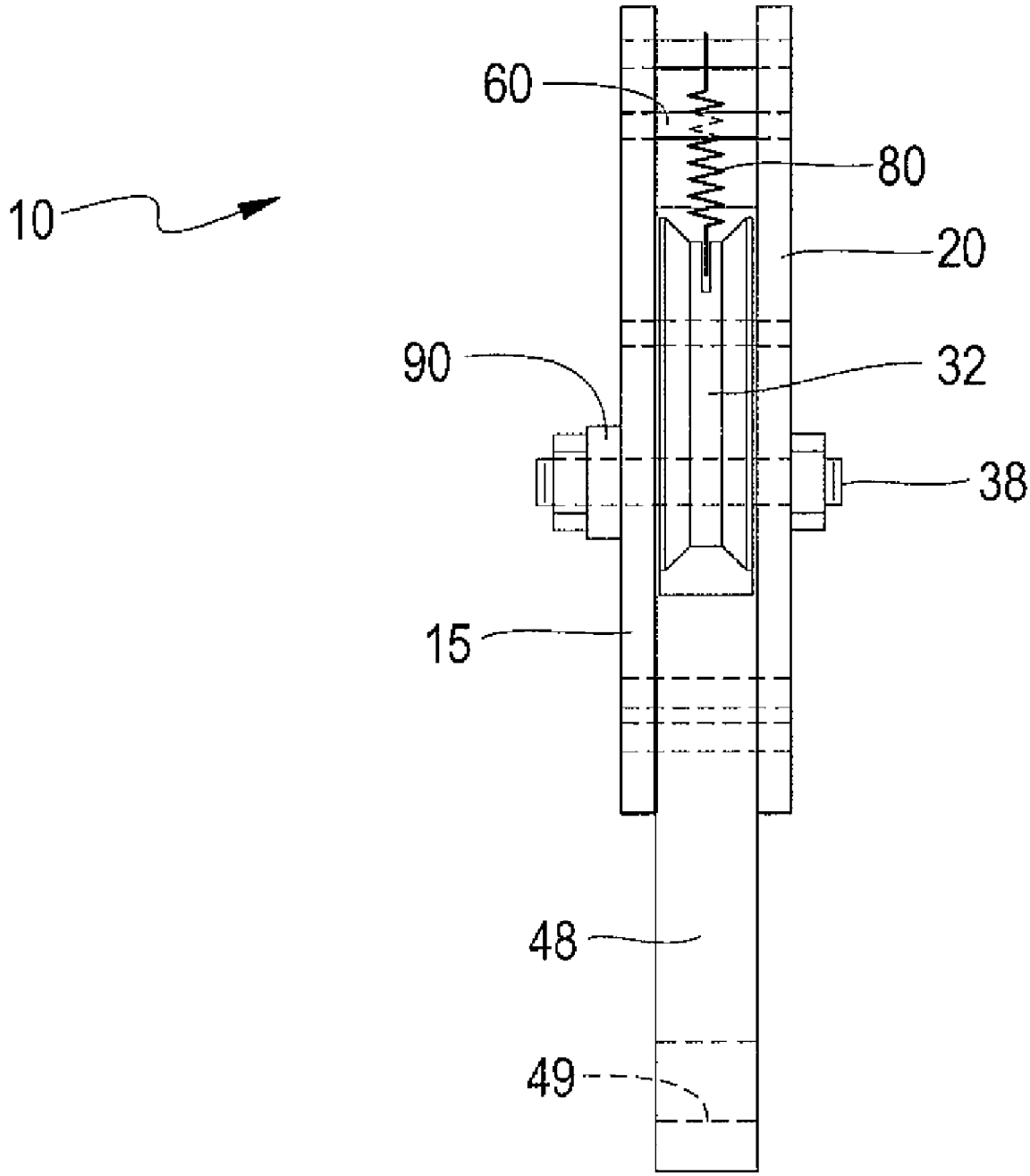
FIG. 3 is an end view of the embodiment shown in FIG. 1.
Figure 4:
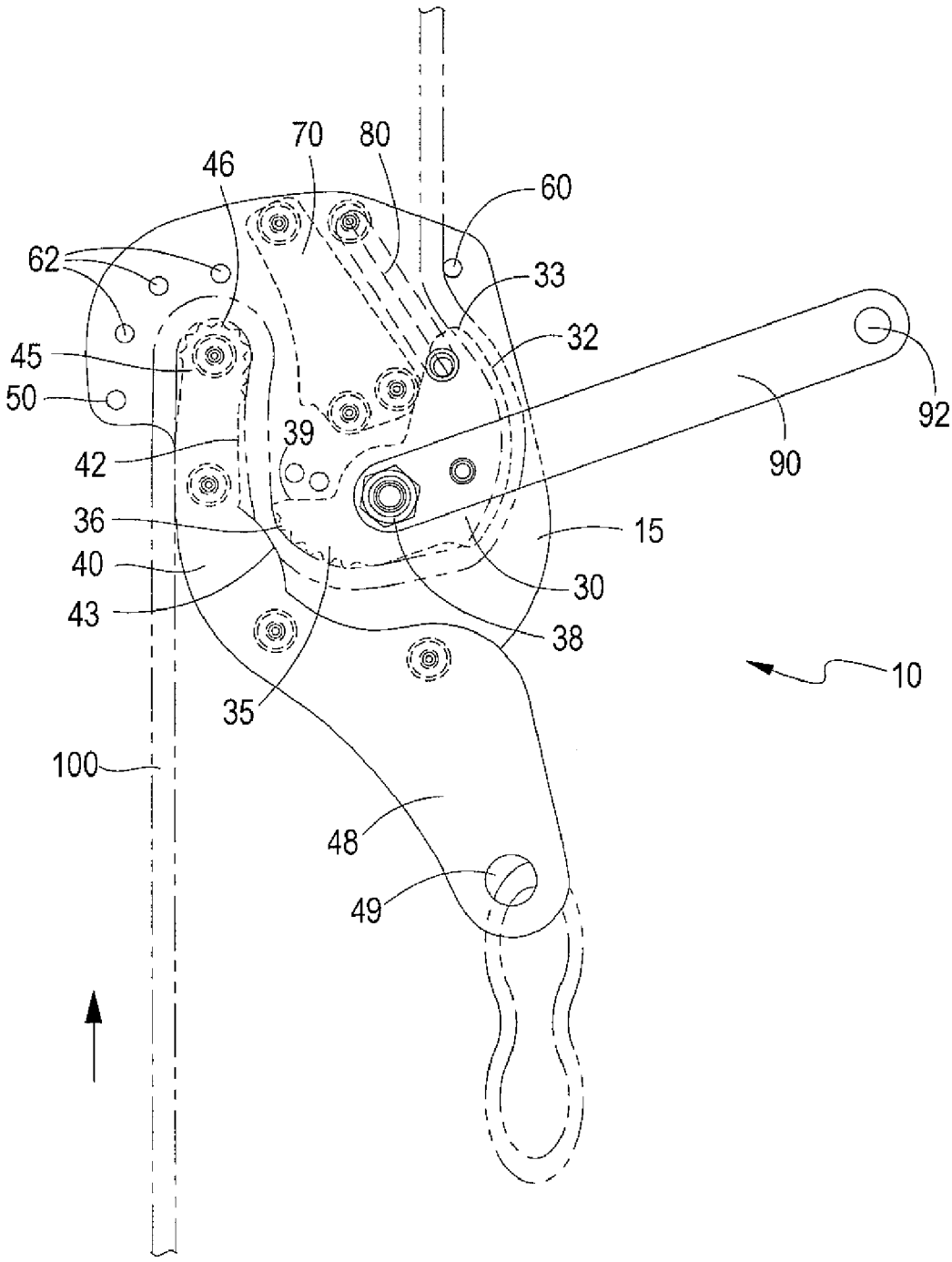
FIG. 4 is a bottom view of the embodiment shown in FIG. 1, with the internal components shown in hidden lines.

Referring to FIGS. 1-3, one embodiment of the present invention comprises a descender 10, which comprises a base 15, a cover 20, a movable cam 30, a fixed guide member 40, an entry pin 50, an exit pin 60, and a cam stop 70. As shown, the entry pin 50, fixed guide member 40, cam 30, and exit pin 60 define a path through which a rope 100 travels through the device, as described in more detail herein. The upward arrow in FIG. 1 indicates the direction of rope travel through the device. A flange 48 may project from either the base 15 or from the fixed guide member 40 to provide an attachment point 49 to which a rope, carabineer, ring, or other device may be attached for securing the descender 10 to a person or object. (The attachment point 49 may be a hole, notch, or slot, although a hole is preferred as being the most secure). In the embodiment shown in FIG. 1, the descender 10 is typically secured to a person via a carabineer and harness attached to attachment point 49. A rope 100 fixed at one end is threaded through the descender 10, and the rope 100 passes through the descender as the person descends the rope 100 as described herein.

The peripheral face of the cam 30 comprises an arcuate shoulder 32 and a jamming surface 35. . The cam 30 pivots about a pivot axis 38 from a closed position, shown in FIG. 1, to an open position, shown in FIG. 2. The shoulder 32 is preferably eccentrically shaped and has a trailing edge 33 extending away from the pivot axis 38, defining a horn. In a preferred embodiment, the jamming surface 35 may be provided with ridges 36 to increase the friction with the rope 100 when the jamming surface 35 bears against it. As shown in FIG. 3, the shoulder 32 may be grooved to provide a track in which the rope 100 may travel.

The fixed guide member 40 is somewhat elongate in shape and terminates in an oblong end 45. The guide member 40 includes an internal lateral face 42 that is generally concave in shape, but preferably includes a raised or convex portion 43 against which the rope may be pressed or jammed by the jamming surface 35 of the cam 30. Likewise, in a preferred embodiment, the oblong end 45 of the guide member 40 may be provided with ridges 46 to increase the friction on a rope bearing against its surface.

The cam stop 70 is positioned to limit the range of motion of the cam 30 as it pivots from the closed position to the open position. In a preferred embodiment, the cam 30 includes a stopping surface 39, which pivots into and against a lateral face of the cam stop 70, as shown in FIG. 2. Thus, the position of cam stop 70 relative to the cam's stopping surface 39 defines the maximum open position of the cam 30. The cam 30 may also be biased into its closed position by a spring 80. A coil spring 80 is shown in FIGS. 1-2, but any biasing member, such as a leaf spring, elastomeric band, or other tensile member could be used.

The descender 10 also includes a torque arm 90 coupled to the pivot axis 38 of the cam 30. The cam 30 may be moved from its open position to its closed position by applying force to the torque arm 90. The torque arm 90 may include an attachment point 92, to which a rope, line, or lanyard may be secured to allow a person remote from the descender 10 to apply force to the torque arm 90 and thus open the cam.

A rope passes through the descender 10, as follows. The rope threads between the entry pin 50 and the oblong end 45 of the fixed guide member 40, defining a rope entry. The rope then passes along the internal lateral face 42 of the fixed guide member 40 and then between the jamming surfaces 35 and 43 of the cam and fixed guide member, respectively. The rope continues along the peripheral face of the cam 30 to its shoulder 32. The rope threads between the shoulder's trailing edge 33 and the exit pin 60, defining a rope exit.

The upper end of the rope, as shown FIG. 1, would typically be fixed, and the descender 10 secured to a person. As tension is applied to the rope by a downward force (such as the person's body weight), friction between the rope and the cam's shoulder 32 causes the cam 30 to pivot into its closed position, jamming the rope between the cam's jamming surface 35 and the jamming surface 43 of the fixed guide member.

A sufficient opposing force applied to the torque arm 90 causes the cam 30 to pivot to its open position. As shown in FIG. 2, as the cam 30 pivots open, the trailing edge 33 of the cam's shoulder pivots away from the exit pin 60. As a result, the rope must travel a more sharply angular path around the trailing edge 33 of the cam's shoulder 32 and the exit pin 60, thus increasing friction on the rope at these points. This frictional force acts to limit the speed of rope travel through the device and thus limits the maximum rate of descent of a person down the rope. The shape of the cam 30, in particular its shoulder 32, and the position of the shoulder 32 relative to the exit pin 60 with the cam in its open position, affect the frictional force on the rope under tension. The oblong end 45 of the fixed guide 40 also exerts a frictional force on the rope under tension. Therefore, these parameters can be altered to provide a descender with a greater or lesser rate of descent under a given load. In one embodiment, a maximum rate of descent of 8 feet/second with a 300 pound load was obtained.

The descender 10 includes another mechanism for controlling rope travel through the device and thereby rate of descent. The path of the rope at the rope entry, relative to the placement of the entry pin 50 and oblong end 45 of the fixed guide, affect the frictional force applied to the rope as it passes through the device. As a person moves the rope entering the rope entry away from the descender 10, the rope bears against the entry pin 50, increasing the friction on the rope and slowing the rate of descent. In addition, the device may be provided with a plurality of orifices 62 sized and adapted to hold the entry pin 50, as shown in FIG. 1. As the entry pin 50 is relocated to a more upward and inward orifice 62, the frictional force applied to the rope at the rope entry is decreased. This may be desirable to accommodate lighter weight persons, whose body weight will put less tension on the rope than a heavier person.

When the descender 10 is put in use, the foregoing structures and functions offer a number of benefits. One intended use for the descender is as a safety device for a person sitting on an elevated platform, to protect him from an accidental fall or to allow a controlled descent. This will be illustrated with the example of a hunter on a deer stand, although the principles and operation of the descender 10 apply to any person similarly situated, such as utility personnel, construction crews working on roofs or high buildings, and the like.

The hunter wears a harness, and the descender 10 is attached to the harness by a carabineer or similar device at attachment point 49. A rope, fixed at its upper end on or near the platform, passes through the descender 10 and hangs to the ground below. If the hunter falls from the platform, the tension on the rope applied by his body weight, in conjunction with the spring, causes the cam 30 to lock into the closed position and jam the rope between the jamming surface 35 of the cam and jamming surface 43 of the fixed guide member, thus rapidly arresting his fall.

His fall having been safely arrested, the hunter may then apply force to the torque arm 90 to open the cam to descend the rope to the ground. As the rope is released from the jamming surface 43 of the fixed guide member, the rope begins to pass through the descender. The cam 30 may be opened only slightly, allowing very slow rope travel, or it may be opened more widely, permitting faster rope travel. As the cam 30 is opened, the rope bears against oblong end 45 of the fixed guide member 40, the peripheral face of the cam 30 including the jamming surface 35 and shoulder 32, and finally against the exit pin 60. The friction generated by rope contact with these surface limits the rate of rope travel. Further, if the hunter were to panic and hold the torque arm such that the cam 30 is fully open and bearing against the cam stop 70, the frictional force on the rope generated by shape and placement of the internal components, as described above, limits the maximum rate of descent of the hunter to a safe rate. If the panicked hunter were to completely release the torque arm, the cam 30 automatically pivots to its closed position, jamming the rope and stopping the descent.

As noted above, a line or lanyard may be attached to the torque arm 90 at attachment point 92. The line should be of sufficient length to reach the ground below the platform or other place on which the person attached to the descender is located. Such a line provides an added measure of safety to the descender 10 as it permits remote operation of the device. Again, using the example of the hunter, if the hunter were to lose consciousness, become injured, or otherwise become incapacitated and fall off the deer stand, the descender 10 would arrest his fall as described above. Then, if the incapacitated hunter were unable to apply force to the torque arm 90 to descend, a person on the ground could pull the line attached to the torque arm 90 and control the descent.

Figure 5:
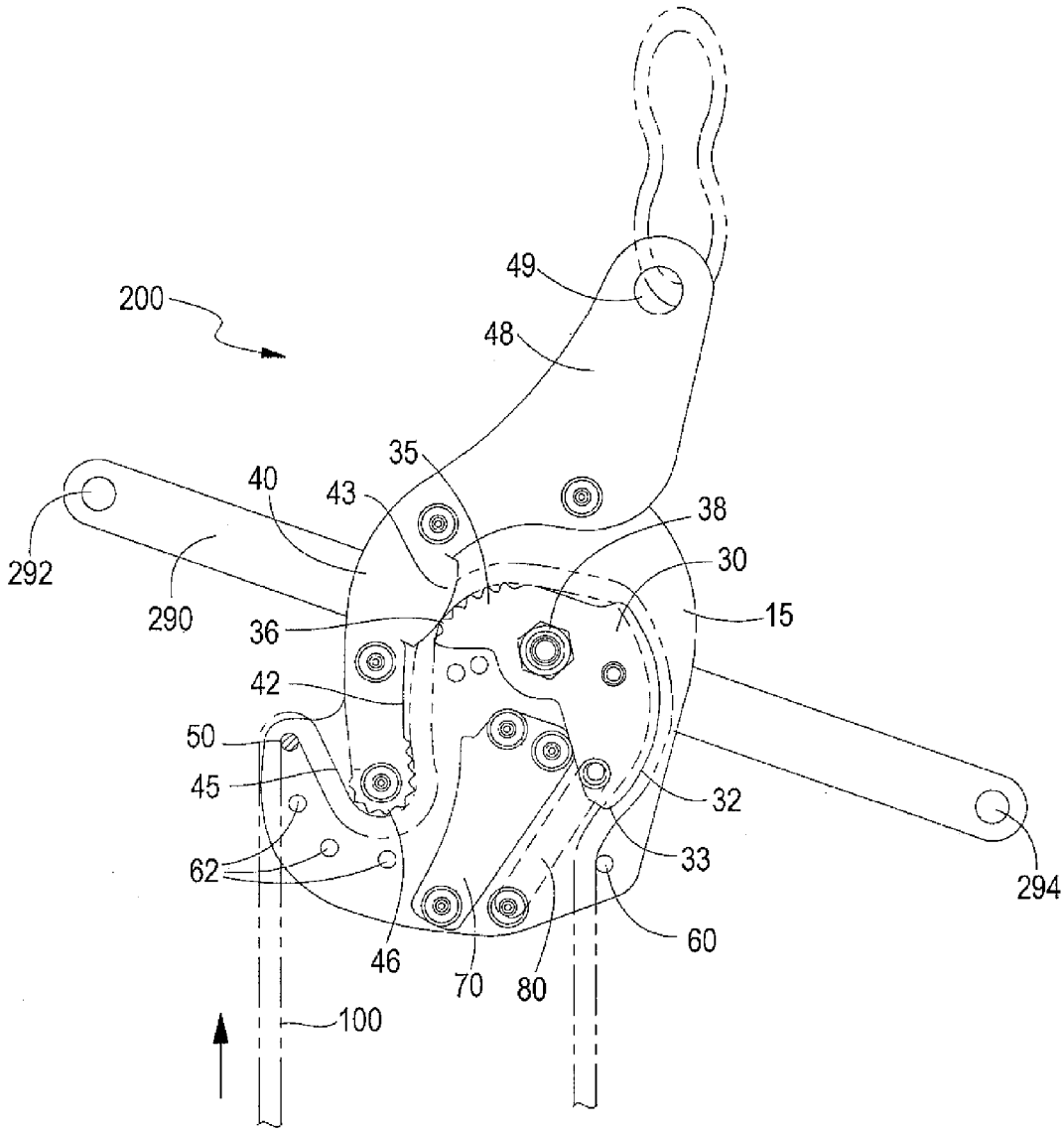
FIG. 5 is a top view of an alternate embodiment of the present invention, with the cover removed to reveal the internal components, with the cam in a closed position against the rope.
Figure 6:
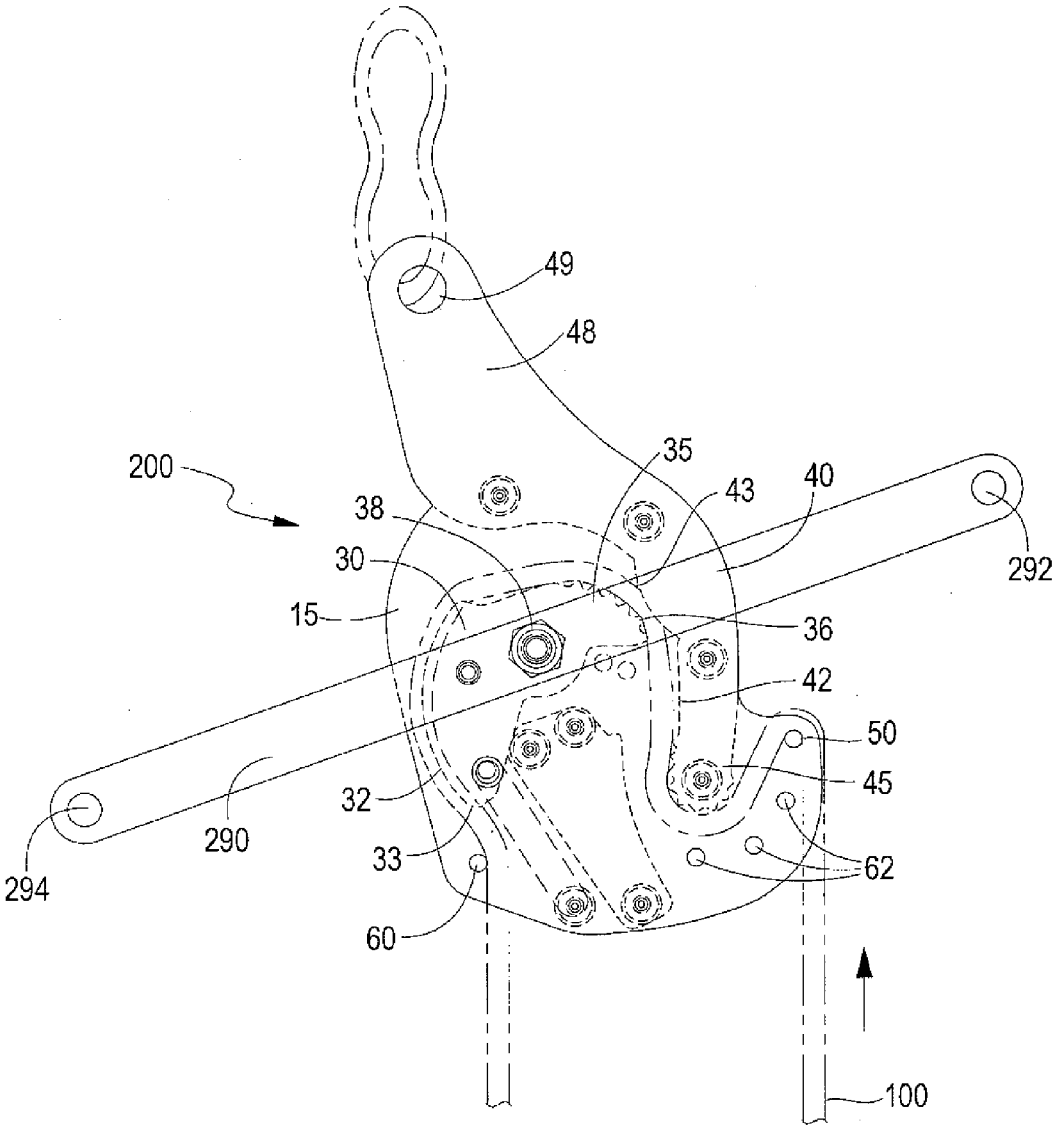
FIG. 6 is a bottom view of the embodiment shown in FIG. 5, with the internal components shown in hidden lines.

A second embodiment 200 is shown in FIGS. 5-6. This embodiment shares the same components and structure as described above with the respect to the embodiment shown in FIGS. 1-4, with the exception of the torque arm. This embodiment also differs in the manner in which it is used. In this embodiment, the descender 200 is secured to and typically hangs from a fixed object via attachment point 49 and the rope 100 is free on both ends. The torque arm 290, as best shown in FIG. 6, is coupled to the pivot axis 38 of the cam 30 and extends radially on either side thereof. Preferably, the torque arm 290 is coupled to the pivot axis 38 proximate its midpoint and includes a first attachment point 292 and a second attachment point 294.

In use, a person or object (the "load") is secured to the rope on that portion of the rope extending beyond the exit pin 60, i.e., the right-hand part of the rope as shown in FIG. 5. The weight of the load causes the cam 30 to move into its closed position, jamming the rope as described above. A second person can apply force to the torque arm 290 to open the cam and control the rate of descent of the load. If a line is attached to attachment point 294, the second person can be remote from the descender 200, such as on the ground below, and control the descent of the load as described above. In this configuration, the fall arrest, controlled descent, and anti-panic features described with respect to the first embodiment are operable.

Although the present invention has been described and shown with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

What is claimed is:

1. A descender for controlling the descent of a person along a rope comprising an entry pin;

a fixed guide member comprising an internal lateral face and an oblong end, said face comprising a first jamming surface;

an assymetric cam pivotable about a pivot axis from an open position to a closed position, the cam having opposing first and second convex arcuate surfaces, said first arcuate surface terminating in a peak of an elongate horn extending from said pivot axis, said second arcuate surface having a radius less than the radius of the first arcuate surface and defining a second jamming surface, wherein the pivot axis is offset closer to said second jamming surface than to said peak; and an exit pin;

the entry pin and said oblong end defining a rope entry; said exit pin and the peak of the horn defining a rope exit; and said internal lateral face, and the peripheral face of said cam, said rope entry and said rope exit defining a rope travel path between said rope entry and said rope exit, wherein said first and second arcuate surfaces define a C-shaped portion of said rope travel path circumscribing the pivot axis of said cam, with said rope in contact with substantially the entirety of said arcuate surfaces with said cam in the closed position;

and further comprising:

a cam stop positioned to stop the pivoting of said cam in its open position; and a torque arm coupled to said pivot axis of said cam for pivoting said cam from said closed position to said open position.

2. The descender of claim 1 wherein the second jamming surface comprises ridges.

3. The descender of claim 1 wherein the oblong end of said fixed guide member comprises ridges.

4. The descender of claim 1 comprising a plurality of orifices adapted to receive said entry pin such that the location of the entry pin is adjustable, thereby allowing adjustment of the rope travel path about said oblong end proximate said rope entry.

5. The device of claim 1, wherein the torque arm comprises a first attachment point for coupling said torque arm to a line, thereby permitting a person pulling said line to remotely operate said descender.

6. The device of claim 1, further comprising bias means for urging said cam into said closed position.

7. The device of claim 1, further comprising a spring coupled to said cam biasing said cam in said closed position.

8. The device of claim 1, wherein said cam stop comprises a fixed member coplanar with said cam.

9. The device of claim 5, further comprising a flange comprising a second attachment point.

10. The device of claim 1, wherein said torque arm has a first end and a second end and is coupled to said pivot axis approximately halfway between said first and second ends.

11. A descender for controlling the descent of a person along a rope comprising:

an assymetric cam pivotable about a pivot axis from an open position to a closed position, said cam comprising a first elongate convex arcuate surface pivotally opposed to a second convex arcuate surface of differing curvature, said first arcuate surface terminating in a peak of a horn extending from said axis, said second arcuate surface defining a first jamming surface;

a fixed guide member having a second jamming surface positioned to engage said first jamming surface with said cam in said closed position;

a rope entry;

a rope exit;

and a torque arm coupled to said pivot axis of said cam for pivoting said cam from said closed position to said open position;

wherein said first and second arcuate surfaces define a substantially C-shaped rope travel path circumscribing the pivot axis of said cam and said rope is in contact with substantially the entirety of said arcuate surfaces with said cam in the closed position.

12. The descender of claim 11, wherein the peak of said horn is separated from said first jamming surface by more than 180 degrees about said pivot axis.

13. The descender of claim 11, wherein said second arcuate surface has a radius less than the radius of the first arcuate surface.

14. The descender of claim 11, wherein said pivot axis is offset closer to said first jamming surface than to the peak of said horn.

15. The descender of claim 11, wherein said cam comprises a groove in said first convex arcuate surface adapted to receive said rope.

16. The device of claim 11, further comprising bias means for urging said cam into said closed position.

17. The device of claim 11, wherein the torque arm comprises a first attachment point for coupling said torque arm to a line, thereby permitting a person pulling said line to remotely operate said descender.

18. The device of claim 17, wherein said torque arm has a first end and a second end and is coupled to said pivot axis approximately halfway between said first and second ends, and wherein each of said first and second ends of said torque arm comprises an attachment point.

19. A descender for controlling the descent of a person along a rope comprising:

an asymmetric cam pivotable about a pivot axis from an open position permitting rope travel through said descender to a closed position in which said rope is jammed, said cam comprising pivotally opposed first and second convex arcuate surfaces defining a substantially C-shaped rope travel path circumscribing said pivot axis, the first arcuate surface having a distal end, said distal end being the point on said rope travel path the greatest distance from said pivot axis;

a fixed guide member having a jamming surface positioned to engage said second arcuate surface with said cam in said closed position;

a fixed exit member that defines a rope exit; and a torque arm coupled to said pivot axis of said cam for pivoting said cam from said closed position to said open position;

wherein as said cam pivots to the open position, the distal end of said first arcuate surface pivots away from said exit member and increases the frictional force of said rope bearing against both said first arcuate surface and said rope exit member.

20. The descender of claim 19, wherein said rope is in contact with substantially the entirety of said arcuate surfaces with said cam in the closed position.

21. The descender of claim 19, wherein said cam comprises a groove in said first convex surface adapted to receive said rope.

22. The descender of claim 19, wherein said fixed member is pin, and further comprising a plurality of orifices adapted to receive said pin such that the location of the rope is adjustable.

23. The device of claim 19, wherein said torque arm has a first end and a second end and is coupled to said pivot axis approximately halfway between said first and second ends, and wherein each of said first and second ends of said torque arm comprises an attachment point.

* * * * *